United States Patent [19]

Kasper

[11] 3,982,321

[45] Sept. 28, 1976

[54] MACHINE AND PROCESS FOR ASSEMBLING CATHODES

[75] Inventor: Cass S. Kasper, Grosse Pointe, Mich.

[73] Assignee: Inter-Lakes Engineering Co., Mount Clemens, Mich.

[22] Filed: Mar. 24, 1975

[21] Appl. No.: 561,615

[52] U.S. Cl. ..... 29/624; 29/203 L; 29/203 P; 29/33 K; 29/33 Q; 29/211 D; 29/211 L; 204/198

[51] Int. Cl.[2] ..... H01B 13/00; B23P 21/00

[58] Field of Search ..... 29/624, 592, 203 R, 29/203 L, 203 D, 203 P, 203 S, 432, 404, 405, 505, 514, 522, 526, 563, 564, 33 R, 33 K, 33 P, 33 Q, 65, 204, 208 R, 208 D, 208 E, 211 R, 211 D, 211 L, 243.5, 243.56, DIG. 3, 34 R, 200 A; 204/194, 198, 202, 208, 214, 245, 280, 286, 290 R, 297 R; 198/27, 28, 31 AA, 31 AB, 31 AC, 34, 81, 236, 106, 160, 161, 166

[56] References Cited

UNITED STATES PATENTS

| | | | |
|---|---|---|---|
| 1,849,081 | 3/1932 | Eppensteiner et al. | 29/33 K |
| 3,711,923 | 1/1973 | Kasper et al. | 29/203 L |
| 3,848,326 | 11/1974 | Lehtovaara | 29/203 L |

*Primary Examiner*—C.W. Lanham
*Assistant Examiner*—Dan C. Crane
*Attorney, Agent, or Firm*—Harness, Dickey & Pierce

[57] ABSTRACT

Copper sheets are fed singly in one direction to a stop. A pair of flat straps are placed in nested positions spaced from the sheet. A suspension bar is fed transversely into position over the mid-portions of these straps. The straps are bent around the bar so that their ends extend toward the sheet. The subassembly comprising the bar and straps are fed toward the sheet until the strap end portions overlap the sheet. Punching and clinching dies then secure the straps to the sheet. The assembly is removed in a transverse direction. A machine is disclosed for performing this process including a carriage for the subassembly, hinge assemblies which convert straight-line piston motion into successive movements to bend the straps, and ramps for permitting the straps to clear a conveyor chain and the die section.

9 Claims, 7 Drawing Figures

MACHINE AND PROCESS FOR ASSEMBLING CATHODES

BACKGROUND OF THE INVENTION

1. Field of the Invention

The invention relates to the manufacture and assembly of cathode assemblies such as are used in electrolytic refinement of copper. These comprise thin sheets of pure copper to be placed between anodes, these sheets being suspended by bars secured to the sheets by looped straps.

2. Description of the Prior Art

My U.S. Pat. No. 3,711,923 issued Jan. 23, 1973 discloses a machine and process for assembling these cathodes in a manner adapted for high production. A disadvantage of the former machine and process is that it may be too expensive to assemble cathodes in that manner when relatively few assemblies are required.

BRIEF SUMMARY OF THE INVENTION

It is an object of the present invention to provide a novel and improved machine and process for assembling cathodes of this type which works on a different principle than previously known machines for this purpose, and permits the manufacture and assembly of relatively small quantities of cathodes in an expensive manner which is nevertheless reliable and rapid.

Briefly, the method of the present invention comprises the steps of moving each sheet singly against a stop, nesting a pair of flat straps in spaced parallel positions and spaced from said sheets, placing and retaining a suspension bar over the mid-portions of said strap, bending the portions of said straps remote from said sheet up and over said bar so that the ends of the straps point toward said sheet, bodily moving the subassembly comprising the straps and bar toward said sheet until the end portions of said straps overlap said sheet, and fastening said overlapping portions of the strap to said sheet.

The machine for carrying out this process comprises vertical stop means for one edge of a rectangular sheet, rail means supporting said sheet for movement against said stop means, a horizontally movable carriage having a first position away from said stop means, means on said carriage for nesting a pair of flat straps which are spaced from the stop means and extend in the direction of carriage movement, means for positioning and holding a suspension bar overlying the mid-portions of said flat straps, means for feeding said suspension bar into said positioning and holding means, means for bending the portions of said straps remote from said stop up and over said positioned and held bar so that both ends of each strap extend toward said sheet, means responsive to the completion of the strap movement for moving said carriage toward its second position so that the end portions of said straps overlap said sheet, and means above and below said sheet in the vicinity of said overlapping strap portions for fastening said overlapping strap portions to said sheet.

BRIEF DESCRIPTION OF THE DRAWINGS

FIG. 3 is a side elevational view of the machine used to carry out the process of this invention;

DESCRIPTION OF THE PREFERRED EMBODIMENT

Figure 1:
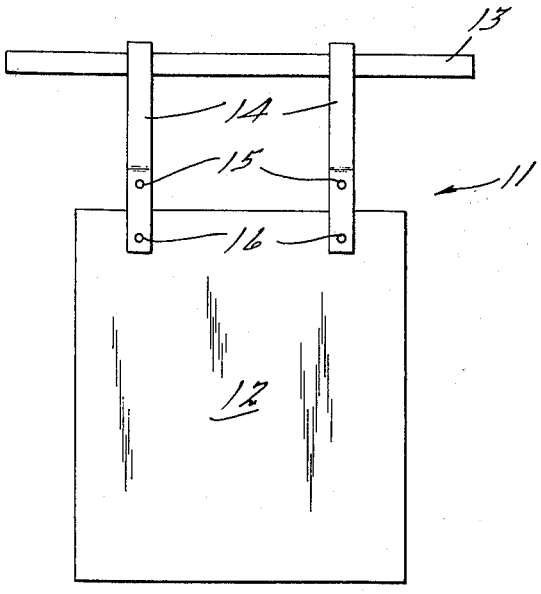
FIG. 1 is a front elevational view of a cathode plate assembly of the type which the present inventon is adapted to prepare.
Figure 2:
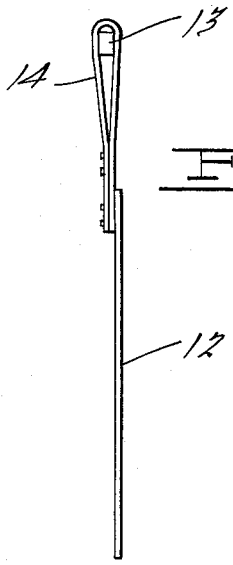
FIG. 2 is a side elevational view of the cathode plate assembly.

The cathode plate assembly which it is an object of this present invention to prepare is indicated generally at 11 in FIGS. 1 and 2 and comprises a thin sheet 12 of pure copper, a suspension bar 13 and a pair of straps 14 connecting the bar and sheet. Sheet 12 is of rectangular shape, as is the cross-sectional shape of bar 13. In their final position, straps 14 are looped over bar 13 and their overlapping ends secured to sheet 12 adjacent one edge, for example by pierced areas 15 and 16 which are clinched over on one side.

The machine comprises a carriage generally indicated at 17 supported by two pairs of stationary spaced parallel guide rails 18 and 19. Carriage 17 has slides 21, each slide being guided within its pair of guide rails 18 and 19, the slides being held in position by cover plates 22 and 23. Slides 21 are connected by a tie bar 24 extending tranversely between the pairs of guide rails.

Each slide 21 is provided with a hinge assembly generally indicated at 25. Each hinge assembly is adapted to be moved between an initial flat horizontal strap-receiving position shown in solid lines in FIG. 3 and a final strap bending position shown in dot-dash lines.

A pair of nests 26 are mounted on the right hand end of the machine as seen in FIG. 3. More particularly, the nests are mounted on stationary portions 27 of the machine which are supported by inclined legs 28. Each nest has a pocket 29 adapted to receive the end of a flat strap 14 shown in dot-dash lines in FIG. 3. The remainder of the strap will lie on the upwardly facing surfaces of hinge assembly 25.

Figure 6:
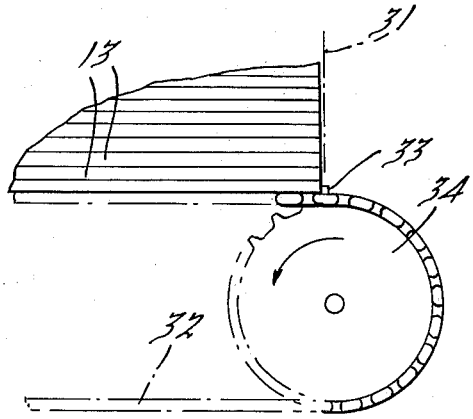
FIG. 6 is a partial schematic view of the suspension bar feeding means.
Figure 2:
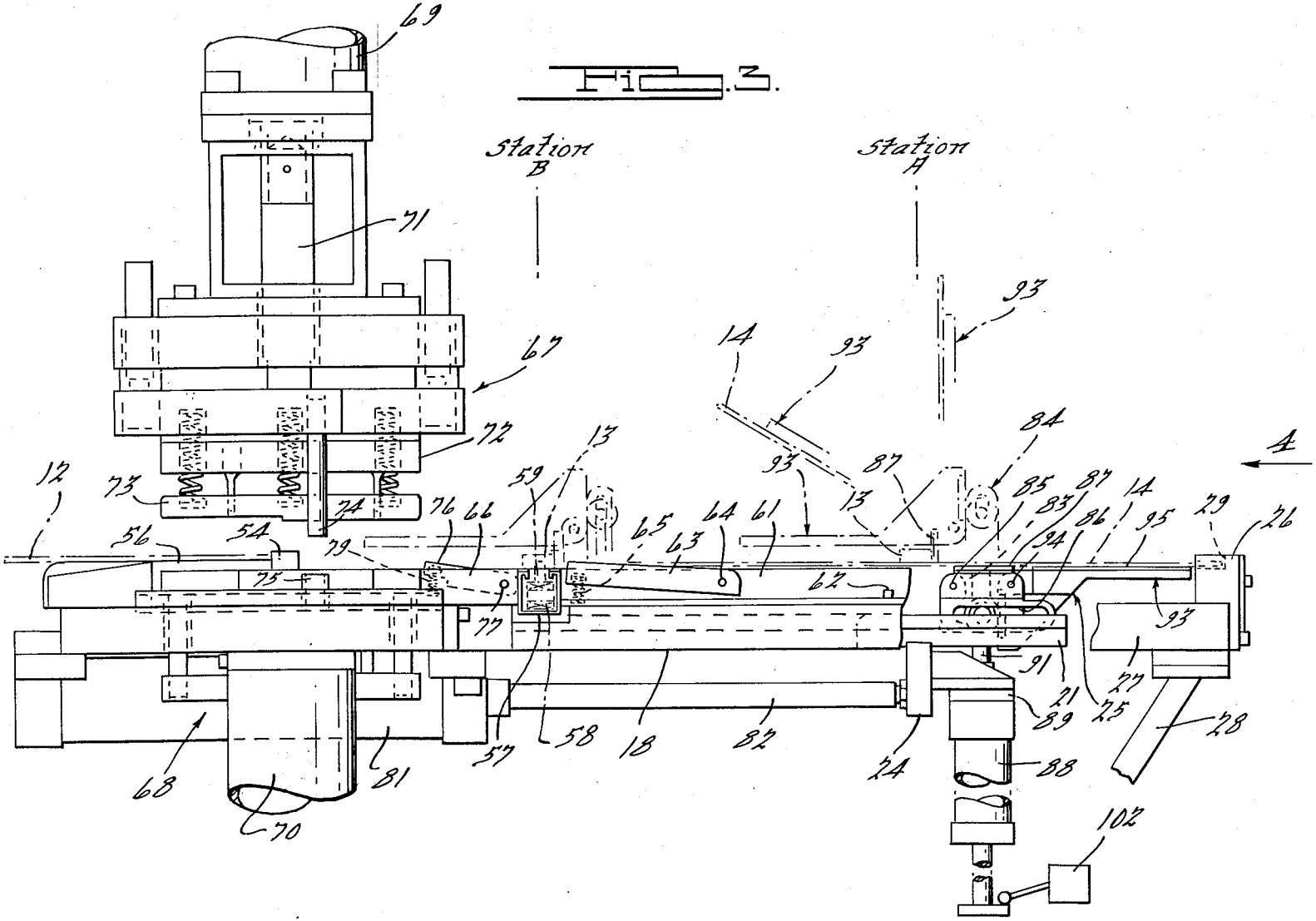

Means are provided for moving a bar 12 into position above a pair of straps 14 which have been previously placed in position within nest pockets 29 and on hinge assemblies 25. As shown in FIG. 6, this means includes vertical guide means shown partially in dot-dash lines at 31 for a stack of bars 13, and endless chain means 32 having spaced cleats 33. Chain means 32 will be driven by a spocket 34 so as to cause cleats 38 to engage the lowermost of the stack of bars 13 which rest on the chain means.

Figure 4:
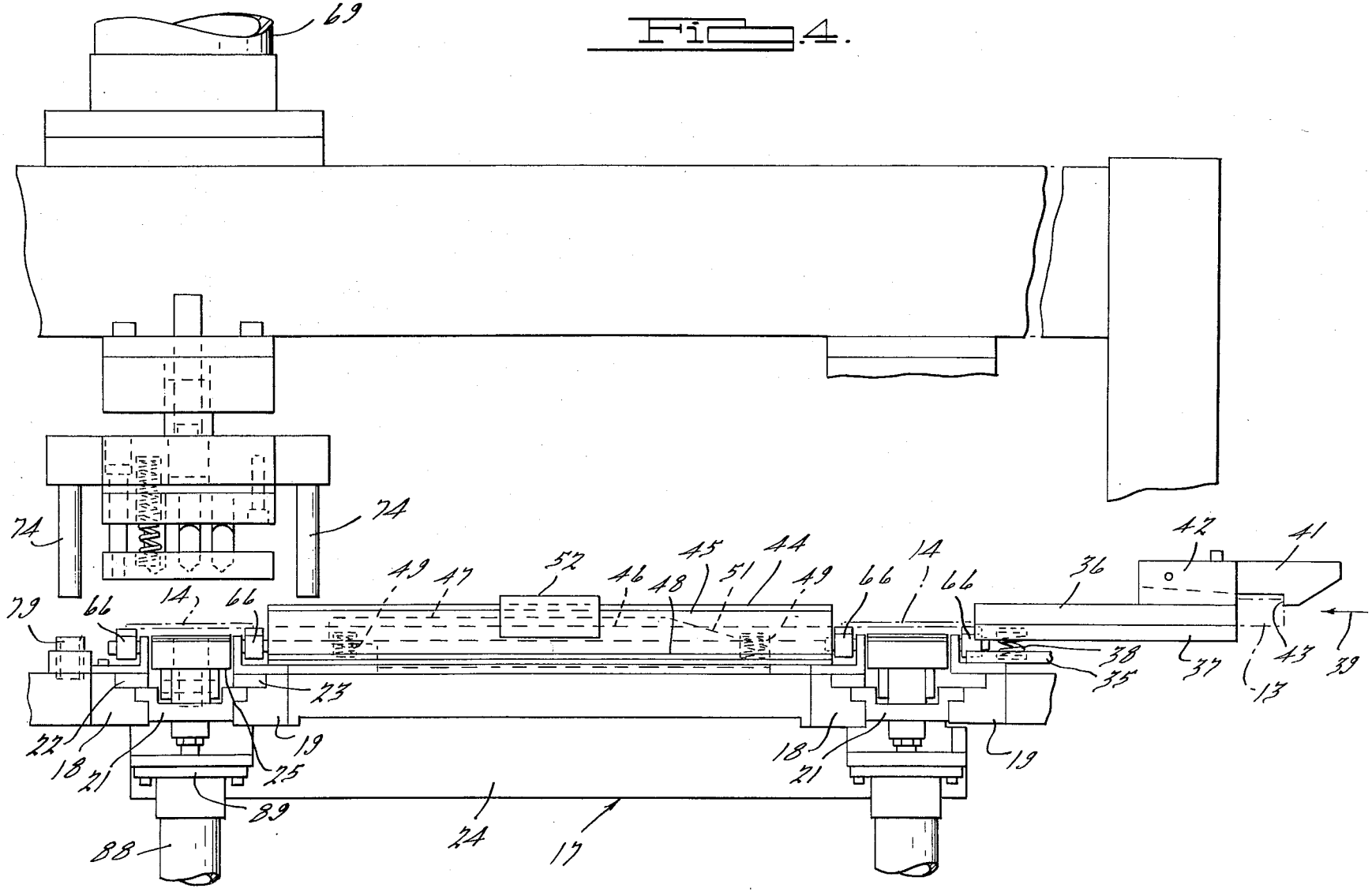
FIG. 4 is a partial front elevational view of the machine looking in the direction of the arrow 4 of FIG. 3.

Chain means 32 is disposed to one side of hinge assemblies 25 when the latter are in their right hand position as seen in FIG. 3. A bar feeder pad 35 shown partially in FIG. 4 is mounted on carriage 17 and is adapted to receive and support each bar 13 as it is fed into position over straps 14. A bar feeder guide 36 is mounted above pad 35 and has a bar pressure pad 37. Spring means 38 is provided between bar feeder pad 35 and bar pressure pad 37 which urges the bar pressure pad upwardly. The bar feeding movement will be to the left as shown by the arrow 39 in FIG. 4. A bar kick-back stop 41 is mounted by means of a bracket 42 on bar feeder guide 36. This stop has a shoulder 43 which will hold bar 13 in its final position after it is fed.

Disposed between the pairs of slides is a bar feeder guide 44 adapted to receive and hold the bar 13 being fed. The bar feeder guide has a downwardly facing angle iron bar guide 45 and an upwardly facing bar pressure pad 46 between which bar 13 is inserted. An angle iron slide 47 is disposed between guide 45 and a cover plate 48, being urged upwardly by a pair of springs 49 between the cover plate and slide. This slide 47 has an inclined ramp 51 at one end so that when bar 13 is inserted it will depress member 47 against the action of springs 49. A bar hold-down 52 is carried by the central portion of bar feeder guide 44 and acts as a spring-loaded locator, having a ledge which holds the bar in place. The bar will thus be held against longitudinal movement and also prevented by resilient locator 52 from moving laterally.

Figure 7:
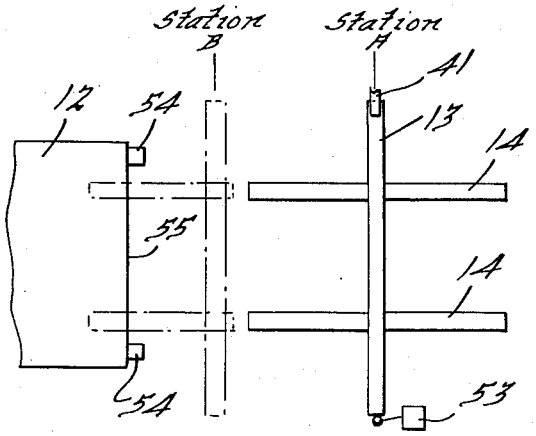
FIG. 7 is a schematic plan view showing the initial and final positions of the strap-and-bar subassembly.

FIG. 7 illustrates the location of bar 13 with respect to straps 14 when it is held in place by the just-described parts. Bar 13 will overlie the mid-portions of straps 14, and a limit switch 53 may be provided which will signal the arrival of bar 13 in its proper location so that the remaining operations of the machine may take place.

FIG. 7 also illustrates schematically the location of sheet 12 in readiness for the approach of the sub-assembly comprising bar 13 and straps 14 after the straps have been folded over the bar. A pair of vertical stops 54 are provided adjacent the left hand end of the machine as seen in FIG. 3. These stops are out of the path of straps 14 when they approach the sheet, and are engagable by edge 55 of the sheet to locate it exactly into position. Skid rails 56 are mounted in advance of stops 54 to support the sheet as it travels toward the stops.

The position of bar 13 overlapping the mid-portions of straps 14 is indicated as "station A" in FIG. 3. During the operation, described below, the bar and bent straps are moved toward plate 12 resting against stops 54, and the bar arrives at a second station, "Station B". A transverse channel 57 is located at Station B and encloses a chain 58 having upwardly projecting cleats 59 which extend from the open channel top. Chain 58 and cleats 59 are used in a manner later described to remove the completed assemblies 11 after straps 14 have been pierced and clinched to sheets 12.

A plurality of guide rails 61 extend between stations A and B for supporting straps 14 and bar 13 when the bar is moved from Station A to Station B. Guide rails 61 are secured to stationary guide rails 18 by fasteners 62. In order to assure that the straps will clear chain enclosure 57 and its associated parts, a plurality of inclined ramps 63 are provided, these ramps being pivoted at 64 to guide rails 61 and being inclined upwardly and forwardly. The guide rails are held in their upward position by spring 65 but will be depressed when bar 13 passes over them.

Additional guides 66 are provided for the straps between enclosure 57 and the location of the die sections which accomplish the piercing and clinching operations. These die sections are indicated generally at 67 (upper die or punch section) and 68 (lower die or clinching section). The upper die section is operated by a cylinder 69 and the lower die section by a cylinder 70. Cylinder 69 has a piston rod adapter 71 connected to a punch 72 carrying a spring-loaded stripper pad 73. Pilot pins 74 carried by the upper die section are received by bushings 75 in the lower die section. In order that the straps 14 being fed toward sheet 12 clear the lower die section, a plurality of inclined ramps 76 are provided. These are pivoted at 77 adjacent dies 66 and urged upwardly by springs 79. As seen in FIG. 4, ramps 66 may be so located as to support the edges of straps 14 being fed toward the sheets.

A double-acting carriage cylinder motor 81 is provided for moving carriage 17 between its two positions. This motor has a piston rod 82 secured at its outer end to tie rod 24. FIG. 3 shows the motor in its extended position for receiving the straps in their nested position and bar 13 at Station A. Retraction of piston rod 82 to the left will move the strap-and-bar sub-assembly until the bar reaches Station B.

Figure 5:
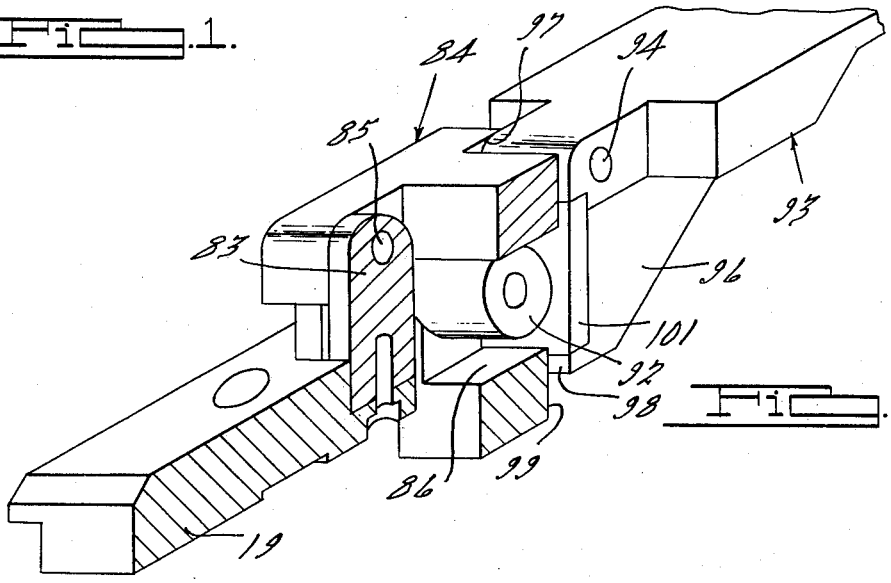
FIG. 5 is a fragmentary and partially schematic perspective view of the hinge assembly.

The construction of each hinge assembly 25 may perhaps best be understood with respect to FIGS. 3 and 5. Each slide 18 and 19 has a pair of upstanding members 83 secured thereto. These members are in spaced parallel relation, and a hinge generally indicated at 84 is pivotally connected at 85 to each pair of upstanding members. Hinge 84 is of elongated shape, having a slot 86 therealong and a wear plate 87. The hinge is movable between a strap-receiving position shown in solid lines in FIG. 3, in which slot 86 and wear plate 87 are horizontal, and a final position shown partially in dot-dash lines in FIG. 3 in which both slot 86 and wear plate 87 are vertical. The means for moving hinge 84 between its strap-receiving and its final position comprises a double-acting reciprocable fluid motor 88 secured at its upper end 89 to the undersides of slides 18 and 19. The upper end of piston rod 91 of this motor carries a roller 92 disposed in slot 86. The axis of piston rod 91 is spaced horizontally from pivot 85 as seen in FIG. 3 so that an upward force on the piston rod will swing hinge counter-clockwise, and vice versa.

A saddle generally indicated at 93 is pivoted at 94 to hinge 84. The saddle is of elongated shape, having a wear plate 95 which, when the saddle is in its strap-receiving position shown in FIG. 3, is horizontal and coplanar with wear plate 87 of hinge 84. The outer end of wear plate 95 will be adjacent recess 29 of nest 26, the bottom of this recess being coplanar with the wear plates. In its final position, shown in dot-dash lines in FIG. 3, saddle 93 will be inverted. That is, wear plate 95 will be facing downwardly. At this point, hinge 84 which carries saddle 93 will have swung 90° about pivot 85, and saddle 93 will have swung 90° about pivot 94.

A lateral portion 96 of saddle 93 extends through a recessed portion 97 in hinge 84 so that extension 96 crosses slot 86 of the hinge when the saddle is in its strap-receiving position. The lower end 98 of extension 96 is engageable by a surface 99 on hinge 84 below slot 86. The position of surfaces 98 and 99 relative to pivot 94 is such that the counter-clockwise swinging of hinge 84 from its strap-receiving to its final position will cause saddle 93 to move in unison with the hinge. When hinge 84 reaches its final position, continued upward movement of roller 92 will cause it to engage a wear plate 101 which extends across the midportion of slot 86. This will cause saddle 93 to swing counter-clockwise about pivot 94 until it reaches its dot-dash line position of FIG. 3. Downward movement of roller 92 in slot 86 will cause both hinge 84 and saddle 93 to be swung clockwise until they return to their initial strap-receiving positions.

In operation, with the parts as shown in their solid line position in FIG. 3, a sheet 12 will be fed against stops 54. A pair of flat straps 14 will be placed in nested position, resting on wear plates 87 and 95 and in nests 26. Bar 13 will then be fed by chain means 32 into position over the midportions of the straps at station A. Upon a signal from limit switch 53, motors 88 will swing hinge assemblies 25 counter-clockwise, bending the straps until they overlap bar 13, with their ends pointing toward plate 12 at stops 54. A limit switch 102 may be provided for sensing the final positions of hinge assemblies 25. This will signal carriage motor 68 to retract carriage 17 to the left. The sub-assembly comprising straps 14 and bar 13, pushed by hinge assemblies 25, will ride along guide rails 61, clearing chain enclosure 57 by virtue of ramps 63, until bar 13 reaches station B. At this point the ends of straps 14 will overlap edge 55 of sheet 12, the straps having been guided into their final position by guides 66 and ramps 76. Die section 67 will then descend as operated by cylinder 69, and pierce the straps and sheet, clinching cylinder 70 causing die section 68 to clinch the pierced portions of the parts. Carriage 17, along with hinge assemblies 25, will then be returned to their right hand positions for the next sub-assembly. Stops 54 will prevent the cathode plate assembly from being dragged to the right along with the carriage. Detents (not shown) could also be provided at station B for this purpose. Upon arrival at station A, motors 88 will retract the hinge assemblies to their initial positions. The completed cathode plate assembly will be removed from the machine by cleated chain 58 moving in channel 57.

I claim:

1. In a process for assembling cathodes of the type having a metal sheet, a suspension bar, and a pair of straps connecting said bar and sheet, the steps of moving each sheet singly against stop means, nesting a pair of flat straps in spaced positions parallel to and spaced from said sheet, one portion of each strap extending toward said sheet, placing and retaining a suspension bar over the mid-portions of said straps, holding said one portion of said straps stationary while bending the portions of said straps remote from said sheet up and over said bar so that the ends of the straps point toward said sheet, bodily moving the subassembly comprising the straps and bar toward said sheet until the end portions of said straps overlap said sheet, and fastening said overlapping portions of the strap to said sheet.

2. A machine for assembling cathodes comprising vertical stop means for one edge of a rectangular sheet, rail means supporting said sheet for movement against said stop means, a horizontally movable carriage having a first position away from said stop means and a second position toward said stop means, means on said carriage for nesting a pair of flat straps which are spaced from the stop means and extend in the direction of carriage movement, means for positioning and holding a suspension bar overlying the mid-portions of said flat straps, means for feeding said suspension bar into said positioning and holding means, means for bending the portions of said straps remote from said stop means up and over said positioned and held bar so that both ends of each strap extend toward said sheet, means responsive to the completion of said strap movement for moving said carriage toward its second position so that the end portions of said straps overlap said sheet, and means above and below said sheet in the vicinity of said overlapping strap portions for fastening said overlapping strap portions to said sheet.

3. The combination according to claim 2, said means for bending said straps comprising a pair of carriage hinge assemblies, each hinge assembly comprising a hinge fixedly pivoted to said carriage and having a first wear surface, said hinge being movable between a first position in which the wear surface is horizontal and faces upwardly, and a second position in which the wear surface is substantially vertical, and a saddle pivoted to said hinge and having a second wear surface, said saddle being movable between a first position in which said second wear surface is coplanar with said first wear surface and a second position in which said second wear surface extends transversely to said first wear surface, a vertically reciprocable motor, and means interconnecting said motor, hinge and saddle whereby initial upward movement of said motor will first cause both said first and second wear surfaces to move in unison from a horizontal to a vertical position, and further upward movement of said reciprocable motor will cause said saddle to swing about its pivotal connection with the hinge so as to move said second wear surface into its second position.

4. The combination according to claim 3, said interconnecting means comprising a horizontal slotted portion on said hinge, a roller on said reciprocable motor disposed in said horizontal slotted portion, coacting surfaces on said saddle and hinge whereby initial upward movement of said reciprocable motor will cause said saddle to swing with said hinge until the slotted portion is vertical, and a third wear surface on said hinge so located as to become aligned with said pin when said slotted portion becomes vertical, whereby further upward movement of said reciprocable motor will swing said saddle around its pivot.

5. The combination according to claim 2, said fastening means comprising upper and lower dies, the machine being further provided with yieldable ramp means adjacent said lower die for guiding said straps in a manner which will clear said lower die.

6. The combination according to claim 2, said means for feeding said suspension bar comprising a guide holding vertically stacked bars, an endless chain below said stacked bars, and spaced projections on said chain for successively pushing individual bars into said positioning and holding means.

7. The combination according to claim 2, said suspension bar positioning and holding means comprising a downwardly facing bar guide and an upwardly facing pressure pad between which the suspension bar is inserted, and a bar hold-down comprising a spring-loaded locator having a ledge which holds the bar in place.

8. The combination according to claim 2, further provided with means for laterally removing each assembled cathode plate assembly, said last-mentioned means comprising an upwardly open enclosure beneath the location of the suspension bar when said carriage is in its second position, and an endless chain in said enclosure having cleats engageable with said bars.

9. The combination according to claim 8, further provided with ramp means adjacent said enclosure for guiding said straps and bar as said carriage moves toward its second position.

* * * * *